United States Patent [19]

Guerrini et al.

[11] 3,983,985

[45] Oct. 5, 1976

[54] TYPING DEVICE OF FLEXIBLE LAMINAE WITH GUIDE MEANS AND VISIBILITY

[75] Inventors: Giampaolo Guerrini, Ivrea; Dario Bisone, Montalto Dora, both of Italy

[73] Assignee: Ing. C. Olivetti & C., S.p.A., Ivrea, Italy

[22] Filed: May 31, 1974

[21] Appl. No.: 475,122

[30] Foreign Application Priority Data

June 19, 1973 Italy ..... 68815/73

[52] U.S. Cl. ..... 197/53; 197/6.7; 197/18

[51] Int. Cl.[2] ..... B41J 1/30; B41J 1/48

[58] Field of Search ..... 197/18, 53, 43, 6.6, 197/6.7; 101/93.18, 93.19

[56] References Cited

UNITED STATES PATENTS

| | | | |
|---|---|---|---|
| 1,064,674 | 6/1913 | Ursbruck | 197/43 |
| 3,157,264 | 11/1964 | Frenchette | 197/53 UX |
| 3,307,676 | 3/1967 | Hickerson | 197/18 |
| 3,566,782 | 3/1971 | Kocher | 197/53 X |
| 3,651,916 | 3/1972 | Becchi | 197/18 X |
| 3,707,214 | 12/1972 | Ponzano | 197/53 |
| 3,840,105 | 10/1974 | Kittredge | 197/53 |
| 3,901,370 | 8/1975 | Poulton | 101/6.7 |

FOREIGN PATENTS OR APPLICATIONS

| | | | |
|---|---|---|---|
| 2,132,345 | 1/1972 | Germany | 197/53 |
| 1,055,211 | 1/1967 | United Kingdom | 197/43 |

*Primary Examiner*—Edgar S. Burr
*Assistant Examiner*—R. E. Suter

[57] ABSTRACT

A typing device comprises a character-bearing disc having a central part for being fixed on a selector shaft and a peripheral rim with a plurality of selectable flexible laminae. Each lamina carries a particular character and striking means flexes the selected lamina to strike against a typing point of a sheet carrying platen for typing. A positioning element, for angular positioning the characters with respect to the typing point, comprises a recess cooperating with a wedge-shaped profile of each one of the selected laminae when the character strikes on said platen. The laminae carry alphabetic and numerical characters and a gap on periphery of the disc enables the last typed characters of a typing line to be seen and read. Further a hooked element cooperates with an elastic means of a flange integral with the selector shaft to removably fix the character bearing disc to the selector shaft.

6 Claims, 8 Drawing Figures

TYPING DEVICE OF FLEXIBLE LAMINAE WITH GUIDE MEANS AND VISIBILITY

BACKGROUND OF THE INVENTION

The present invention relates to a typing device comprising a character-bearing disc of plastics material having a central part by which it is fixed to a selector shaft and a plurality of flexible laminae radiating from the central part, each carrying a particular character. A hammer is used to cause lamina of the selected character to strike against a sheet-bearing platen for typing. The invention particularly concerns positioning means used for angular positioning of the character relative to the typing point.

A typing arrangement of the above-mentioned kind is known, in which positioning of the character is obtained by rotation of the character-bearing disc by means of a step-wise drive and the striking is obtained by means of the hammer which selectively engages the laminae under the control of an electromagnet. With this solution typing is very fast, but the lamina is not guided, either during the approach of the hammer nor during the striking. In addition to this, angular positioning of the step-wise drive and of the character-bearing disc cannot be precise, both because of the tolerances of manufacture of the relative parts, particularly the drive rotor, and because of oscillation of the disc prior to its positioning. Therefore, both the alignment of the typing on the sheet and the neatness of the printed letters are to some extent open to improvement.

Typing arrangements are also known in which a disc of plastics material is continuously rotatable and the lamina beneath the character to be typed is caught on the fly by the hammer. The hammer has a circular rim and rectifies the position of the lamina by acting on a radial channel formed on the face of the lamina opposite that bearing the character. In this way the problem of alignment is partially solved, but to obtain sufficient robustness of the channelled laminae there is required a lamina width greater than is strictly required by the character. This involves discs of rather cumbersome diameter.

SUMMARY OF THE INVENTION

One object of the invention is, therefore, to provide a typing device with a character-bearing disc having flexible laminae that are not too cumbersome and in which the characters are typed with alignment and neatness equal to those of standard typewriters.

According to the present invention, there is provided a typing device comprising a character-bearing disc of plastics material having a plurality of laminae radiating from a central part, each lamina carrying a particular character, means for rotating a selected lamina to a typing point, a hammer operable to strike the selected lamina towards a platen to effect typing of the character, and a positioning element for rectifying the angular position of the selected lamina at the typing point, wherein each lamina has a portion with a wedge-shaped profile and the positioning element has a complementary recess into which the wedge-shaped profile of the selected lamina is arranged to enter.

In order to avoid breakage of the character-bearing disc on account of excessive oscillation of the laminae, it is preferred that the lamina are substantially uniform in width and thickness decreasing radially outwardly, so as to obtain, over the entire length of the lamina, substantially uniform bending stresses when the laminae are struck by the hammer for typing.

A typical problem for character-bearing discs is that of permitting visibility of the latest character imprinted on the sheet of paper. According to a known arrangement, the characters of the disc are each carried on an element inclined relative to the radial lamina. With this solution there is the inconvenience that, during typing, the lamina is not only bent but also twisted. This increases the tendency towards breakage of the laminae. In addition, this movement does not permit clean striking in the plane of the characters on the page, and leads to the typed characters being smudged.

In another known arrangement, the disc is provided at its perimeter with a gap to allow visibility. An inconvenience of this solution is that to contain all the characters and symbols required, the disc must have a diameter greater than is strictly necessary, resulting in this case also in greater clumsiness and inertia.

In order to overcome this problem, the gap can be formed by a plurality of contiguous laminae which bear characters of lesser height than other characters and which are of less length than the other laminae.

As described below, improved means may be provided for releasably attaching the disc to a flange of a selector shaft, whereby removal and fitting of the disc are rendered very simple and quick without sacrificing security of fixing or reliability of alignment of the disc.

BRIEF DESCRIPTION OF THE DRAWINGS

The invention will be described in more detail, by way of example, with reference to the accompanying drawing, in which.

DESCRIPTION OF THE PREFERRED EMBODIMENT

Figure 1:
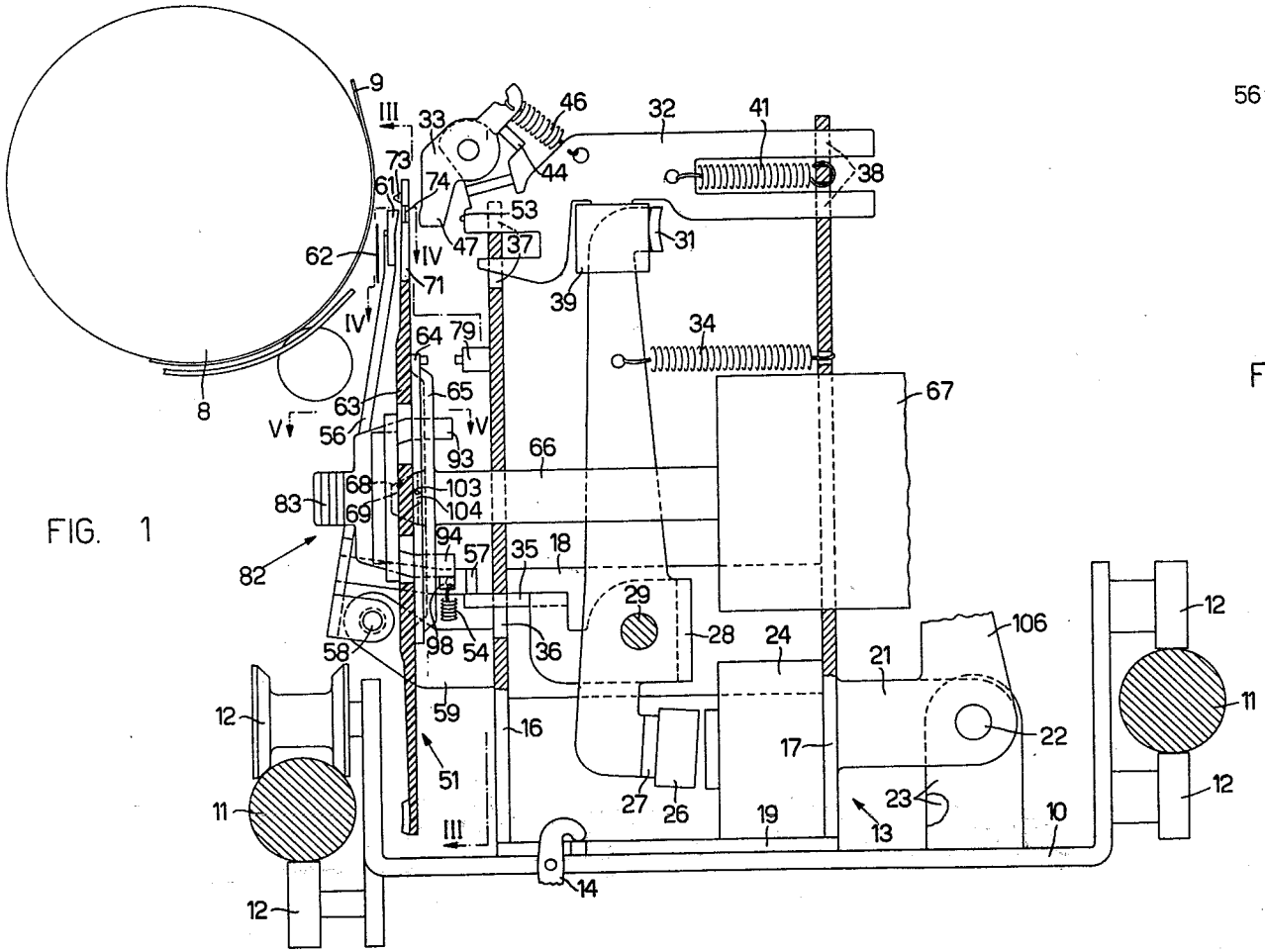
FIG. 1 is a partial section of a typing device embodying the invention.

With reference to FIG. 1, the typing device comprises a normal papercarrying platen 8 on which lies the typing sheet 9, and a carriage 10 transversely movable across the typing sheet 9 along guides 11. The carriage 10 runs on the guides 11 by means of rollers 12 mounted on ball bearings and capable of sliding in both directions, for example, under the action of a reversible electric motor, not shown in the drawings, as described in U.S. Pat. No. 3,707,214, of Ponzano, assigned to the same assignee as this application, and incorporated herein by reference.

A frame 13 stands on the carriage 10 and is held down by a hook 14. The frame 13 is composed of vertical plates 16 and 17 connected by two crosspieces 18 (FIG. 2) and by a base plate 19 (FIG. 1). The frame is hinged to the carriage 10 by means of lugs 21 integral with the plate 17, lugs 23 standing up from the carriage 10, and pivot pins 22. The frame 13 can thus be swung up when the hook 14 is released.

An electromagnet 24 fixed to the vertical plate 17 and to the base plate 19 co-operates with an armature 26 integral with a lug 27 of a bail 28. The bail 28 can be rotated on a spindle 29 supported by the cross-piece 18 (FIG. 2), and by means of a lug 31, co-operates with a striking support 32 of a hammer 33 (FIG. 1). A spring 34 normally holds the bail 28 motionless with a lug 35 pressed against the top of a slot 36 in the vertical plate 16.

The support 32 is perpendicular to the platen 8 and is slidably guided in slots 37 and 38 provided in the vertical plates 16 and 17 respectively. The support 32 is normally positioned with a rubber element 39 pressed against the lug 31 of the bail 28 under the action of a tension spring 41 anchored to the vertical plate 17.

The hammer 33 is pivoted on the support 32 and is normally held at rest against a lug 44 of the support 32 by means of a biasing spring 46. One end 47 of the hammer 33 has an outer edge designed to co-operate with a character-bearing disc 51, and an inner edge designed to engage a shoulder 53 of the support 32.

Figure 2:
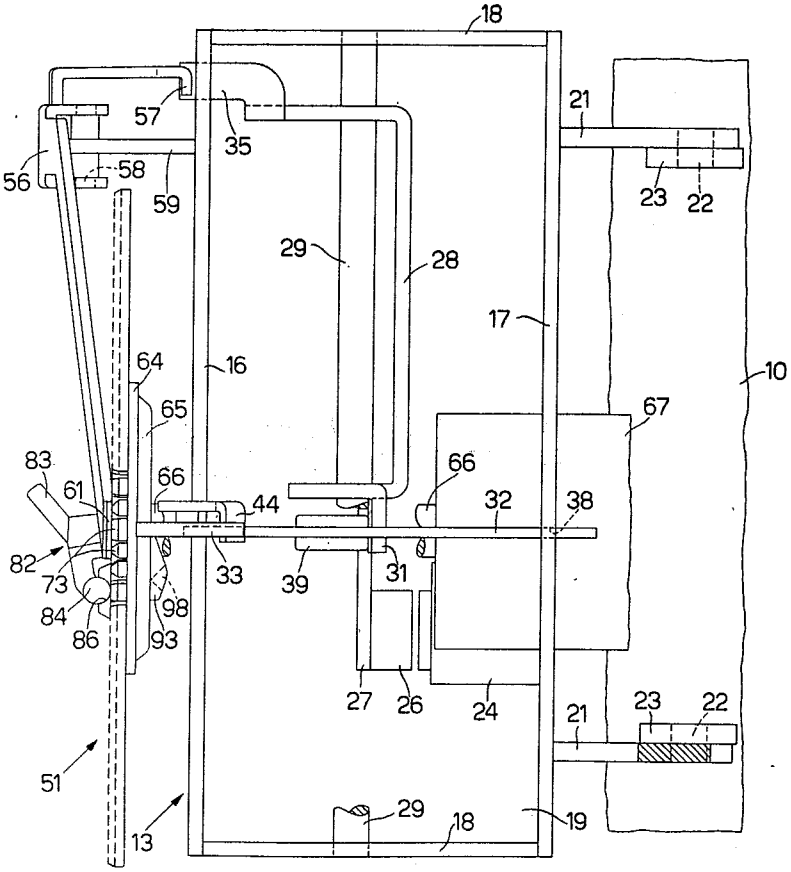
FIG. 2 is a partial plan view of FIG. 1.
Figure 3:
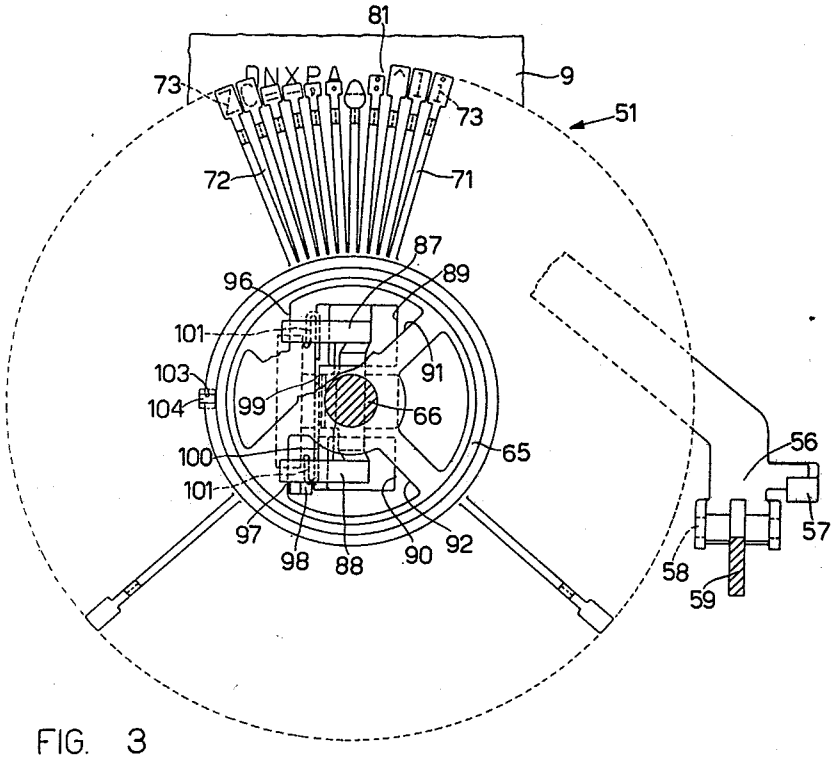
FIG. 3 is a partial section along the line III—III of FIG. 1.

A positioning block 61 (FIGS. 1 and 2) is mounted at the upper end of a positioning arm 56 having a bracket structure at its lower end pivoted by a pin 58 on a tongue 59 integral with the plate 16, (FIGS. 1, 2 and 3). A spring 54 urges the arm 56 clockwise in FIG. 1 so that a lug 57 bears against the lug 35 of the bail 28. The positioning block 61 is transversely centered at the typing point between the disc 51 and an inked ribbon 62.

Figure 4:
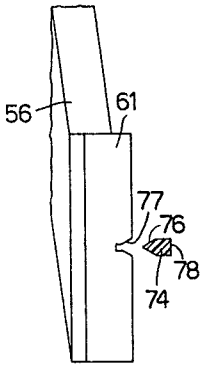
FIG. 4 is a partial section along the line IV—IV of FIG. 1 on a larger scale.

The character-disc 51 is constructed of flexible plastics material, for example, nylon reinforced with fiberglass, and has a substantially plane central part 63 attached to a peripheral rim 64 of a flange 65 of a selector shaft 66 for the disc, rotatable stepwise by an electric motor 67. The central part 63 has a conical seat 68 designed to be engaged by a conical end 69 of the selector shaft 66. The central part 63 is in one piece with a rim of reduced thickness and flexible laminae 71 of substantially uniform width radiating from the rim and separated by radial slits 72 (FIG. 3). Each lamina 71 has at one end a corresponding type character 73. The thickness of the laminae 71 decreases radially outwardly, so as to obtain, over the whole length of the lamina 71, substantially constant bending stresses when the laminae 71 are flexed by the hammer 33 for typing. Radially inside the character 73, each lamina 71 has a neck 74 (FIG. 4) with a wedge-shaped profile 76 on the character side and a flat profile 78 on the hammer side. The wedge 76 is designed to enter a complementary recess 77 in the positioning block 61. Recess 77 is wedge shaped and has an enlarged apex portion to receive the point of wedge 76 and accommodate for wear thereof.

Figure 8:
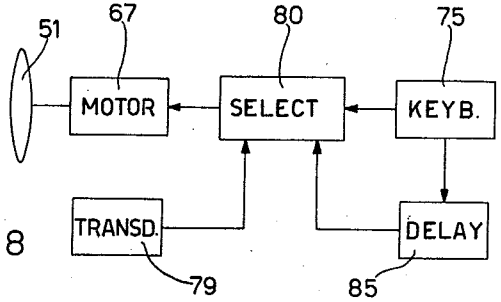
FIG. 8 is a diagram relating to the control of a detail of FIG. 1.

Selection of the type characters 73 is effected through the step-by-step motor 67 (FIG. 8) under the control of a keyboard 75 for operating a selection circuit 80 synchronised by a transducer 79 substantially as described in the aforementioned U.S. Pat. No. 3,707,217.

The type characters 73 (FIG 3) are composed of upper and lower case alphabetical characters, numerical characters, punctuation marks, and arithmetical and other graphic signs commonly used in traditional office machines. In the character disc 51, the punctuation signs, for example: from left to right in FIG. 3: = (equals), - (hyphen), , (comma), . (full stop or period), _ (underline), are carried by contiguous laminae 71 as represented in FIG. 3. These laminae, corresponding to the above-cited signs, have their extremities set back relative to the extremities of the remaining laminae, thus leaving a gap 81 on the periphery of the disc 51.

The typewriter, teleprinter, calculator or other office machine incorporating the typing device in question, comprises a delay circuit 85 (FIG. 8) which automatically, after a fixed time during which there has been no actuation of the keyboard 75, rotates the motor 67 so as to bring the sign _ (underline) of the character-disc 51 over the typing point as shown in FIG. 3. In this way the gap 81 allows the latest characters imprinted on the typing sheet 9 to be visible ad readable.

Figure 5:
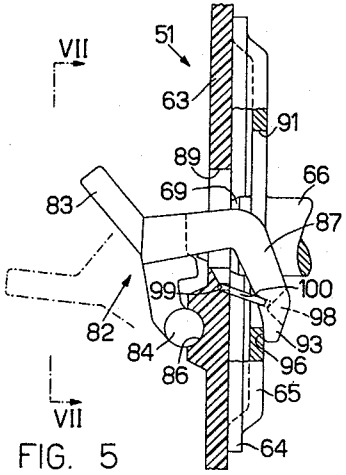
FIG. 5 is a partial section along the line V—V of FIG. 1 on a larger scale.

The character-bearing disc 51 is normally fixed to the rim 64 (FIG. 1) of the selector shaft 66 by means of a hooked element 82 (FIG. 5). The element 82 is composed of a handle 83, a cylindrical bar 84 designed to lodge in a cylindrical seat 86 of the character-disc 51, and of two L-shaped arms 87 and 88 (FIG. 3) spaced from each other and designed to pass through respective apertures 89 and 90 in the disc 51 and corresponding apertures 91 and 92 of the flange 65 located on diametrically opposite parts relative to the selector shaft 66. Each of the arms 87, 88, has a wedge-shaped end 93 (FIG. 5) or 94 respectively, whose under part co-operates with an edge 96 (FIG. 3) or 97 respectively of the apertures 91 and 92. Integral with the arm 88 is a tooth 98 designed to co-operate with the lower edge of the aperture 90 to prevent disengagement of the element 82 (FIG. 5) as will be described later.

Figure 7:
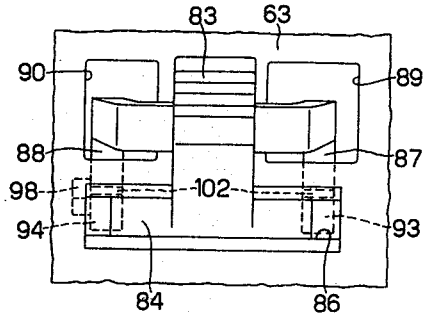
FIG. 7 is a partial view along the line VII—VII of FIG. 5.

A channel 99 cut in the disc 51 connects the two apertures 89 and 90 (FIG. 3) and is the seat for a spring 100. The spring 100 is of the compression type and is substantially C-shaped, its central portion being guided in the channel 99. The two ends 101 of the spring 100 engage in two channels 102 (FIG. 7) of the arms 87 and 88. Moreover, the ends 101 (FIG. 3) are bent outwards through 90° to engage the inner parts of the arms 87 and 88, thus preventing longitudinal displacement of the spring 100 when it is connected between the disc 51 and the element 82 (FIG. 5).

The flange 65 (FIG. 3) has a trapezoidal seat 103 designed to take a tooth 104 (also trapezoidal) which is integral with the disc 51. This matching has been arranged in order to ensure that the disc 51 can only be fixed to the flange 65 in one angular orientation.

Figure 6:
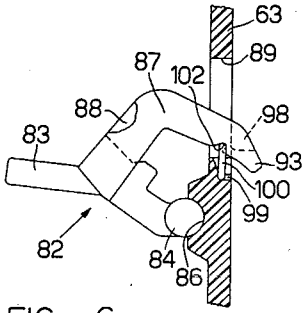
FIG. 6 is a partial view of some details of FIG. 5 in another working position.

In order to fix the hooked element 82 (FIG. 5) on the character-bearing disc 51, the following mode of action is employed. The handle 83 (FIG. 6) is grasped with one hand and the bar 84 is engaged in the corresponding seat 86. The element 82 is then turned clockwise so as to make the arms 87 and 88 enter the apertures 89 and 90, care being taken to keep the element 82 off-center with respect to the center of the disc 51 so that the tooth 98 (FIG. 7) passes through the aperture 90 without interfering with the lower edge of the aperture 90. The element 82 is then centered with respect to the center of the disc 51, sliding the bar 84 into the seat 86 until the tooth 98 rests below the edge of the aperture 90 as shown in FIG. 3. The compression spring 100 is now inserted, engaging the channel 99 with the mid-part of the spring 100, and with the ends 101, the channels 102 of the arms 87 and 88. The ends 101, bent outwards at 90°, press against the inner parts of the arms 87 and 88 and prevent the spring 100 from running into the channel 99. The spring 100 now exerts pressure on the arms 87 and 88 (FIG. 6) and makes the element 82 turn anti-clockwise until it stops with the tooth 98 against the lower edge of the aperture 90 as shown in FIG. 6.

The procedure for fitting the disc 51 on the selector shaft 66 is as follows. The hook 14 (FIG. 1) is released in a known manner, by means not shown in the drawings, and a lever 106 is engaged with one hand, swinging the frame 13 up on the pins 22 so as to bring the shaft 66 into a substantially vertical position, i.e. turned through 90° from the normal position. The disc 51 (complete with element 82 and spring 100) is taken and placed with the seat 68 on the conical end 69 of the shaft 66, with the central part 63 against the peripheral rim 64 of the flange 65 and with the trapezoidal tooth 104 in the seat 103 of the rim 64.

The handle 83 is grasped, making the element 82 rotate clockwise so that the arms 87 and 88 (FIG. 3) snap through apertures 91 and 92 against the action of the spring 100. The spring 100 initially opposes such rotation as far as the dead point, and favors rotation after that. The arms 87 and 88 engage their wedge-shaped ends 93 and 94 (FIG. 7) on the edges 96 (FIG. 3) and 97 respectively so that the disc 51 is firmly fixed on the selector shaft 66. The fixing pressure exerted by the wedge-shaped ends 93 (FIG. 1) and 94 makes the conical seat 68 adhere to the end 69 of the shaft 66 and the rim of the central part 63 adhere to the corresponding peripheral rim 64 of the flange 65. The fixing pressure is exerted on an intermediate zone, between the conical coupling and the zone of contact of the rims, which takes up any possible play. The spring 100 (FIG. 3) exerts continuous pressure between the disc 51 and the arms 87 and 88 of the element 82, keeping it always in the fixing position.

The frame 13 (FIG. 1) is now swung down again and latched by means of the hook 14. To remove the disc 51, the operations described above are carried out in reverse order.

The operation of the typing machine according to the invention is similar to that described in the aforementioned U.S. Pat. No. 3,707,214. The difference lies essentially in the positioning block 61 and the hammer 33.

After selection of the character that is to be typed, a known device, not shown in the drawings, controlled by the selection circuit 80 (FIG. 8) raises the inked ribbon 62 (FIG. 1) to bring it into alignment with the typing line. The electromagnet 24 rotates the bail 28 counter-clockwise against the action of the spring 34. The spring 54 then rotates the positioning arm 56 carrying the positioning block 61 in the clockwise direction, making the block 61 engage the neck 74 of the selected lamina. The wedge 76 (FIG. 4) starts to enter the recess 77.

The lug 31 of the bail 28 makes the support 32 slide in the slots 37 and 38 towards the paper carrying platen 8 against the action of the spring 41. The hammer 33 engages with its outer edge the flat profile 78 (FIG. 4) of the neck 74. If the wedge 76 is not perfectly lodged in the recess 77, in a first phase the hammer 33 pushes the lamina into the recess 77 and rotates in the counter-clockwise direction against the action of the spring 46 (FIG. 1) until it stops against the shoulder 53. The spring 46, however, exerts a retarding action on the lodgement of the neck 74 in the positioning block 61 and prevents rebound. Now the hammer 33, reacting to the shoulder 53 of the support 32, bends the lamina 71 until it types the selected character 73 on the typing sheet 9 on the platen 8. At the same time the hammer 33 causes the positioning arm 56 to rotate counter-clockwise against the action of the spring 54 and thus allows the positioning block 61 to guide the lamina 71 during the approach and during the stroke.

When excitation of the electromagnet 24 stops, the spring 34 rotates the bail 28 until the lug 35 stops against the top of the slot 36. The spring 41 returns the support 32 to rest against the lug 31, while the spring 46 turns the hammer 33 and arrests it against the lug 44. At the same time the spring 54 brings the positioning arm 56 back into its rest position, with the lug 57 against the lug 35, and the inked ribbon 62 also returns to its initial position. The whole device is now again at rest and ready for a new cycle.

It is evident that each lamina 71 carries a single type character 73 and is provided with a wedge-shaped cam profile 76 on the same face that carries the character, and that the cam profile 76 is intended to co-operate in a complementary recess 77 of the positioning block 61 for angular positioning of the selected lamina 71.

We claim:

1. A typing device comprising a selector shaft; a character-bearing disc having a central part fixed on said selector shaft and a plurality of substantially flat flexible laminae, each lamina having an end integral with said central part and a second end provided with a portion carrying a particular character; a sheet-carrying platen; selecting means for rotating said selector shaft so as to position one of said plurality of laminae in alignment with a typing point on said platen; striking means cooperative with said portion for flexing the selected lamina along a striking direction to strike the character carried thereon against said typing point; each of said plurality of laminae having a substantially constant first dimension measured perpendicular to said striking direction from said end to said second end and a second dimension measured parallel to said striking direction that decreases radially from said end to said second end, so that said flexible laminae are substantially aligned therebetween along the whole length of the lamina and that the whole length of the lamina is subject to high flexibility and substantially constant bending stresses when the selected lamina is flexed along said striking direction by said striking means.

2. A typing device comprising a sheet-carrying platen; a character-bearing disc faced to said platen and having a peripheral rim with a plurality of flexible laminae, each lamina carrying on a face opposite the platen a particular character and a positioning profile; means for selecting one of said laminae in front of a typing point of said platen; a positioning member located between said platen and said disc comprising a recess engageable by said positioning profile for angularly positioning said selected lamina with respect to said typing point; means supporting said positioning member for movement thereof between said platen and said selected lamina; spring means biasing said positioning member towards said selected lamina; a hammer member actionable for striking the selected lamina on a second face opposite said face for flexing the selected character toward the platen and typing the character carried thereof against said typing point; electromagnet means including an armature actionable from a rest to an operative position; and an intermediate member operatively connecting said armature with said hammer member and with said positioning member for arresting said positioning member at a predetermined distance from said selected lamina against the biasing of said spring means when said armature is in the rest position and for jointly actuating said hammer member and releasing said positioning member when said armature is in said operative position to allow said spring means to move said positioning member towards said selected lamina so as to enable said recess to engage said positioning profile with a movement opposite to the direction of flexing of said selected lamina, whereby positioning said selected lamina well before the typing of the character against the typing point.

3. A typing device comprising a character-bearing disc of plastic material having a peripheral rim with a plurality of flexible laminae, each lamina carrying a particular character having a wedge-shaped profile defined by two lateral surfaces converging towards a substantially radial edge thereof, said edge being aligned with respect to said character; a sheet-carrying cylindrical platen; means for selectively positioning one of said plurality of laminae in front of a typing point on said cylindrical platen; striking means for flexing said selected lamina to strike the character carried thereof against said typing point for typing; a positioning member for angularly positioning said wedge-shaped profile of said selected lamina with respect to said typing point, said positioning member comprising a recess for accommodating said wedge-shaped profile; said recess being defined by a pair of opposed lateral surfaces configured in an inner apex portion of substantially rectangular cross-section and an outer V-shaped portion of diverging cross-section extending outwardly from said apex portion; the distance between said opposed sides in said apex portion being greater than that of said radial edge; means supporting said positioning member with said recess in alignment with said typing point perpendicular to said cylindrical platen when said striking means flexes the selected lamina to effect the striking of the carried character thereof; said wedge-shaped profile entering said recess to be aligned thereby with said radial edge being received in said apex portion so that said recess exactly aligns said wedge-shaped profile also when said wedge-shaped profile is worn or deformed.

4. A typing device comprising a selector shaft; a character-bearing disc having a central part fixed to said selector shaft and a plurality of flexible laminae, each lamina carrying a particular character and a positioning profile; a sheet-carrying platen; means for rotating said selector shaft so as to selectively position one of said plurality of laminae in front of a typing point of said platen; a positioning member movably supported for cooperating with the profile of the selected lamina for angularly aligning said selected lamina with respect to said typing point; and means for causing the character of the selected lamina to be struck on said sheet and for positioning without rebound said profile in said positioning member; said means for causing the character to be struck comprising a hammer supported on a support for movement between a first position and a second position; a restraining spring connecting said hammer to said support; and means operable for actuating said support between a rest position and an operative position; said support including a first member normally arresting said hammer in said first position against the action of said restraining spring and a second member arresting said hammer in said second position, said restraining spring allowing said hammer to flex the selected lamina until said profile engages said positioning member prior to the striking of said character upon actuation of said support toward said operative position, and said second member causing said hammer to further flex said selected lamina so that the character carried thereof is struck against said typing point for typing while held aligned with respect to said typing point by said positioning member.

5. A typing device comprising a selector shaft; a character-bearing disc having a central part fixed on said selector shaft and a peripheral rim with a plurality of flexible laminae, each of said laminae having an end fixed to said central part and a free end opposite said fixed end provided with a support portion carrying a corresponding character; a sheet-carrying platen; selecting means for rotating said selector shaft so as to selectively position the support portion of one of said plurality of laminae in alignment with a typing point on said platen; striking means flexing the selected lamina to cause the character carried by said support portion to be struck against said typing point, means for reciprocally moving said disc with respect to said platen for aligning characters typed on the sheet with respect to a base line of said platen; the support portion of said laminae comprising a first group having a first radial dimension and a second group having a second radial dimension less than said first radial dimension, the characters carried by said second group being of lesser radial dimension than said characters carried by said first group, the free ends of said second group defining a gap in the outermost periphery of said disc, delay means for positioning the support portion of said second group in alignment with said typing point a predetermined time after a character has been printed so as to allow the last typed characters to be at least partially read and recognized through said gap.

6. A typing device according to claim 5, in which the support portion of said second group of laminae carry the characters selecting the following signs: __ (underline), . (full stop), ,(comma), - (hyphen).

* * * * *